US006095151A

United States Patent [19]

Arthur

[11] Patent Number: 6,095,151

[45] Date of Patent: Aug. 1, 2000

[54] CIGARETTE PACKING DEVICE

[76] Inventor: Richard Randal Arthur, 8 April Village, Montgomery, Tex. 77356

[21] Appl. No.: 09/017,336

[22] Filed: Feb. 2, 1998

[51] Int. Cl.[7] ..... A24B 1/10; A24C 1/08

[52] U.S. Cl. ..... 131/112; 131/111; 131/329; 100/214; 100/265; 100/268

[58] Field of Search ..... 131/80, 111, 112, 131/115, 329; 100/214, 265, 268

[56] References Cited

U.S. PATENT DOCUMENTS

| | | | |
|---|---|---|---|
| 117,377 | 7/1871 | Brewer . | |
| 401,587 | 4/1889 | Porter | 131/112 |
| 924,107 | 6/1909 | Ritter et al. . | |
| 944,758 | 12/1909 | Woerner . | |
| 1,571,548 | 2/1926 | Horton et al. . | |
| 2,425,727 | 8/1947 | Butz . | |
| 3,761,215 | 9/1973 | Tondato | 100/268 |
| 4,045,152 | 8/1977 | Peterson et al. | 100/268 |
| 4,230,214 | 10/1980 | Cortez | 194/57 |
| 4,257,321 | 3/1981 | Wheeler et al. | 100/268 |
| 4,957,271 | 9/1990 | Summers et al. | 100/265 |

FOREIGN PATENT DOCUMENTS

| | | | |
|---|---|---|---|
| 84721 | 1/1896 | Germany | 131/111 |

OTHER PUBLICATIONS

The American Heritage Dictionary, 2nd College Edition, p. 1402, "Yoke" Defined, 1982.

*Primary Examiner*—Stanley S. Silverman
*Assistant Examiner*—Michael P. Colaianni

[57] ABSTRACT

A flat base anchored to any hard, smooth surface by two suction cups. Upon this flat base, two shafts rise perpendicular. The base supports a housing which fits over the base shafts. The housing has an opening which accommodates a standard pack of cigarettes, which are placed in the opening top or filter first. Two springs are located above the housing on the base shafts to create tension. Rubber caps at the top of the base shafts, aided with epoxy, contains the springs and housing to the base of the invention so that once the housing is pulled upward by one's hand the housing then is forced down toward the base from the tension of the springs and consequently "packing" the cigarettes.

1 Claim, 12 Drawing Sheets

IDENTIFICATION DRAWING

A. RUBBER CAPS
B. SPRINGS
C. HOUSING
D. BASE
E. SUCTION CUPS
F. BASE SHAFTS

IDENTIFICATION DRAWING

A. RUBBER CAPS
B. SPRINGS
C. HOUSING
D. BASE
E. SUCTION CUPS
F. BASE SHAFTS

FRONT/REAR VIEW, BASE

SIDE VIEW, BASE

TOP VIEW, BASE

BOTTOM VIEW, BASE

FRONT/REAR VIEW, HOUSING

SIDE VIEW, HOUSING

TOP VIEW, HOUSING

BOTTOM VIEW, HOUSING

RUBBER CAP VIEWS
FIG. 10A TOP VIEW
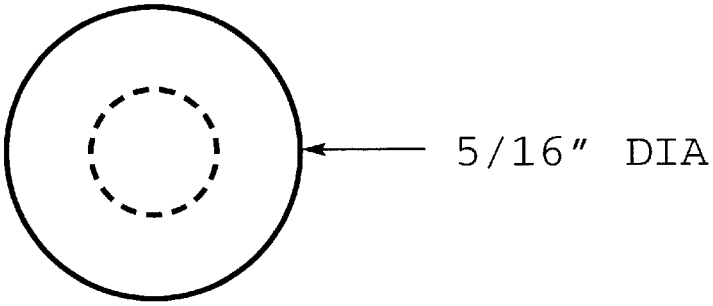
FIG. 10B BOTTOM VIEW
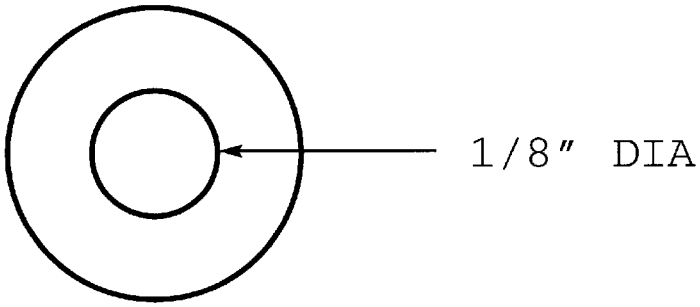
FIG. 10C FRONT VIEW
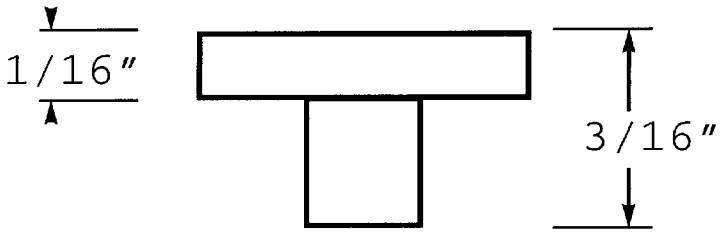

SUCTION CUP VIEWS
FIG. 11A TOP VIEW
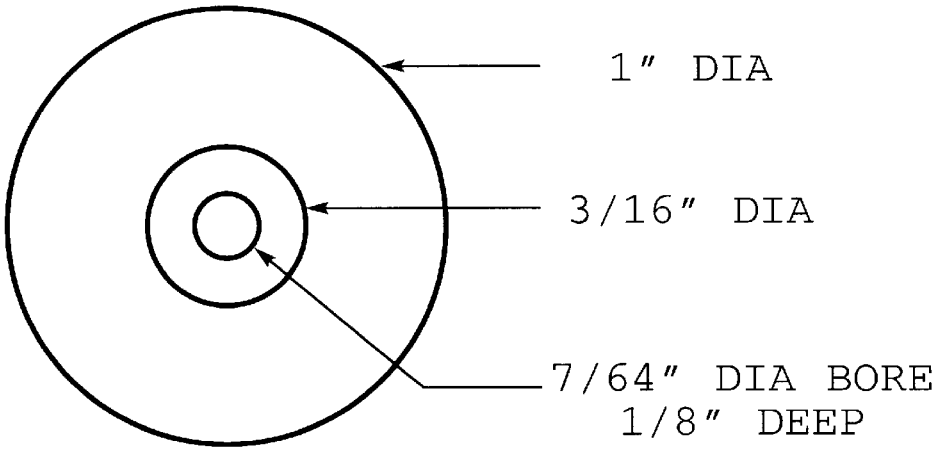
FIG. 11B FRONT VIEW
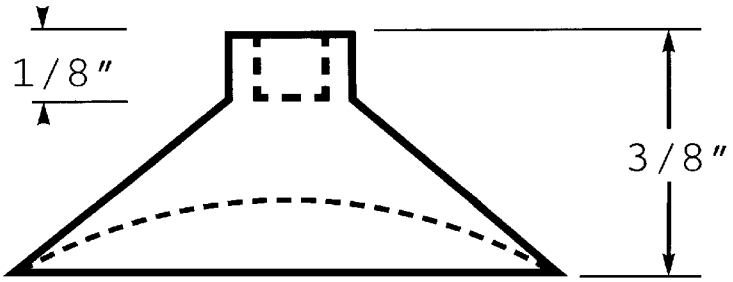

SPRING VIEWS
FIG. 12A FRONT VIEW
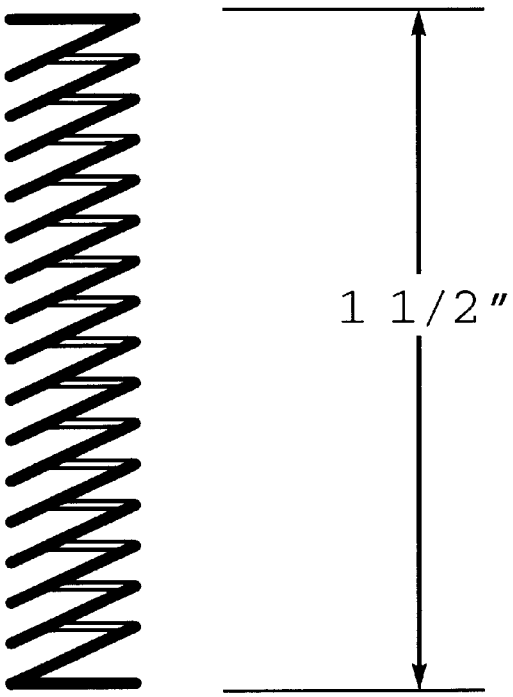
FIG. 12B TOP VIEW
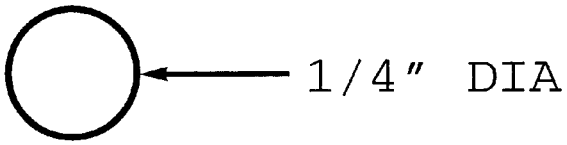

CIGARETTE PACKING DEVICE

BACKGROUND OF THE INVENTION

1. Field of the Invention

The present invention relates to a device used to pack the tobacco contained in a cigarette. More specifically, the present invention relates to the compression of the tobacco toward the filter of the cigarettes located in a standard size pack of cigarettes.

2. Prior Art

"Packing a cigarette" is a common phrase known to people who smoke. This phrase means to tighten the tobacco located within a cigarette toward the filter. This creates a cigarette that burns slower when lit and is consequently easier to ash. In the past, packing a cigarette could only be achieved by rapping a pack of cigarettes, top first, against one's hand or a hard surface to create a driving impact which would slowly move the tobacco within the pack toward the filters. How well the cigarettes were packed depended on the talent of the individual performing the act of packing the cigarettes.

No device is known, however, for effectively creating consistently packed cigarettes.

SUMMARY OF INVENTION

The objective of the present invention is to effectively create consistently packed cigarettes, regardless of one's personal talent or hand to eye coordination. It is also the objective of the present invention to provide such a device which is of simple and inexpensive construction.

These objectives can be achieved by providing a plastic base anchored to any hard, smooth surface by two rubber suction cups. Upon this flat base, two cylindrical shafts will rise perpendicular. The purpose of this base is to support a plastic cigarette housing which fits over the shafts of the base. The housing has an opening in the top to hold a pack of cigarettes.

Two springs located above the housing on the shafts of the base are present to create tension as the housing is pulled upwards by one's hand. These springs are held in place by two rubber caps attached to the tops of the base shafts.

With all these components of the invention properly attached and in place, consistently packed cigarettes can be achieved again and again. (refer to the detailed description of drawings for further details)

BRIEF DESCRIPTION OF DRAWINGS

FIG. 1 is a frontal identification drawing of the invention showing and identifying all parts and components in actual size.

FIG. 2 is a frontal and rear view of the base section of the invention in actual size excluding the housing, springs, rubber caps, and suction cups.

FIG. 3 is a side or left and right view of the base section of the invention in actual size excluding the housing, springs, rubber caps, and suction cups.

FIG. 4 is a top view of the base section of the invention showing location, center lines, and diameters of the base shafts in actual size excluding the housing, springs, rubber caps, and suction cups.

FIG. 5 is a bottom view of the base section of the invention showing location, center lines, and diameters of the suction cup attachments located on the bottom of the base in actual size. This drawing excludes the housing, springs, rubber caps, and suction cups.

FIG. 6 is a frontal and rear view of the housing section of the invention in actual size excluding the base, springs, rubber caps, and suction cups.

FIG. 7 is a side or left and right view of the housing section of the invention in actual size excluding the base, springs, rubber caps, and suction cups.

FIG. 8 is a top view of the housing section of the invention in actual size showing location, center lines, and diameters of holes which the base shafts run through. This drawing also includes the radius of the arcs and the dimensions of the rectangular cigarette opening of the housing, excluding the base, springs rubber caps, and suction cups.

FIG. 9 is a bottom view of the housing section of the invention in actual size showing location, center lines, and diameters of holes which the base shafts run through. This drawing also includes the radius of the arcs excluding the base, springs, rubber caps, and suction cups.

FIGS. 10A, 10B and 10C

FIGS. 10A, 10B and 10C are a complete drawings of all the views needed in relation to the rubber caps which are located atop the base shafts (refer to FIG. 1). FIGS. 10A, 10B and 10C are enlarged six times that of actual size.

FIGS. 11A and 11B

FIGS. 11A and 11B are a complete drawings of top and front or side views of the suction cups which are located beneath the base and are attached to the suction cup attachments of the base (refer to FIG. 1). FIGS. 11A and 11B are three times larger than actual size.

FIG. 12

FIGS. 12A and 12B are complete drawings of the views involved with the springs which are located on the base shafts, above the housing and contained by the rubber caps (refer to FIG. 1). FIGS. 12A and 12B are two times larger than actual size.

DETAILED DESCRIPTION

Figure 1:
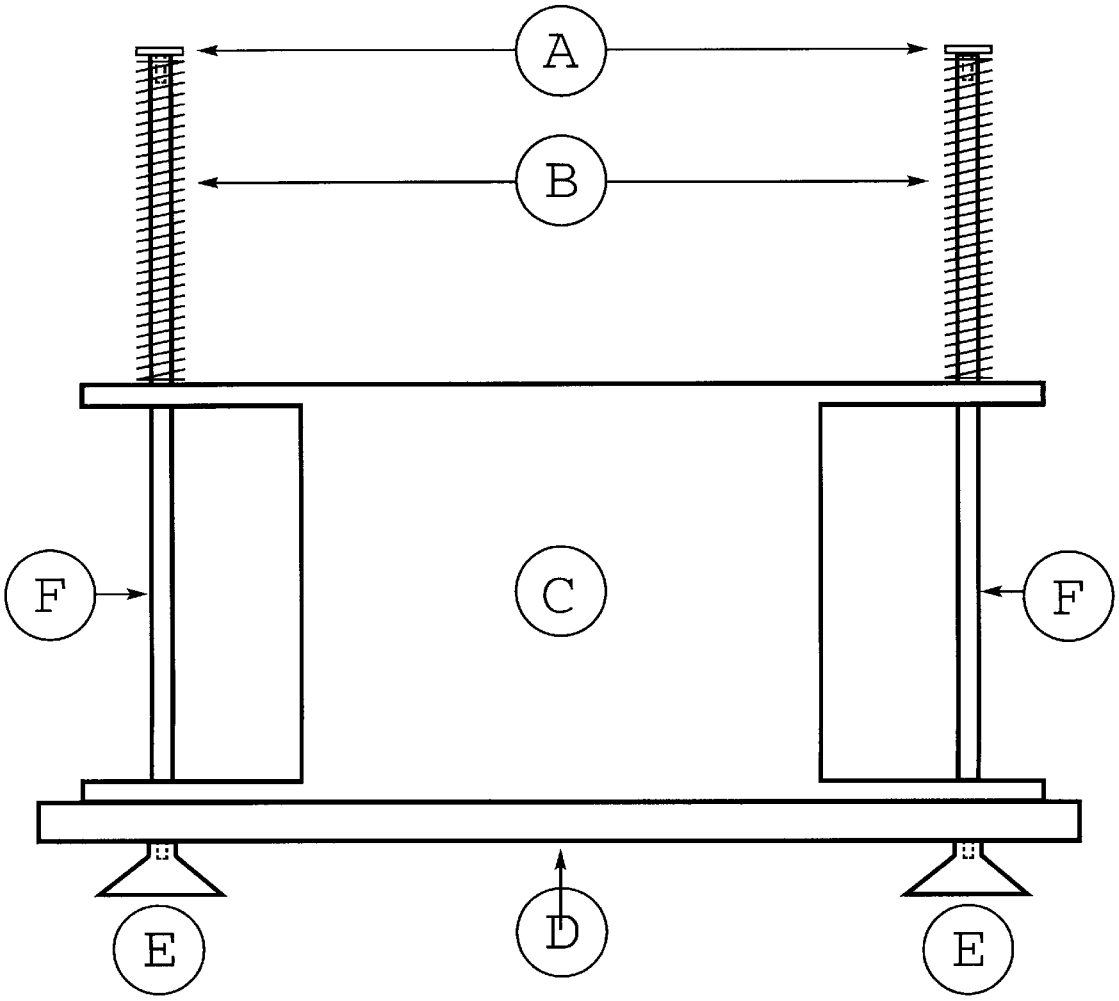
FIG. 1
Figure 2:
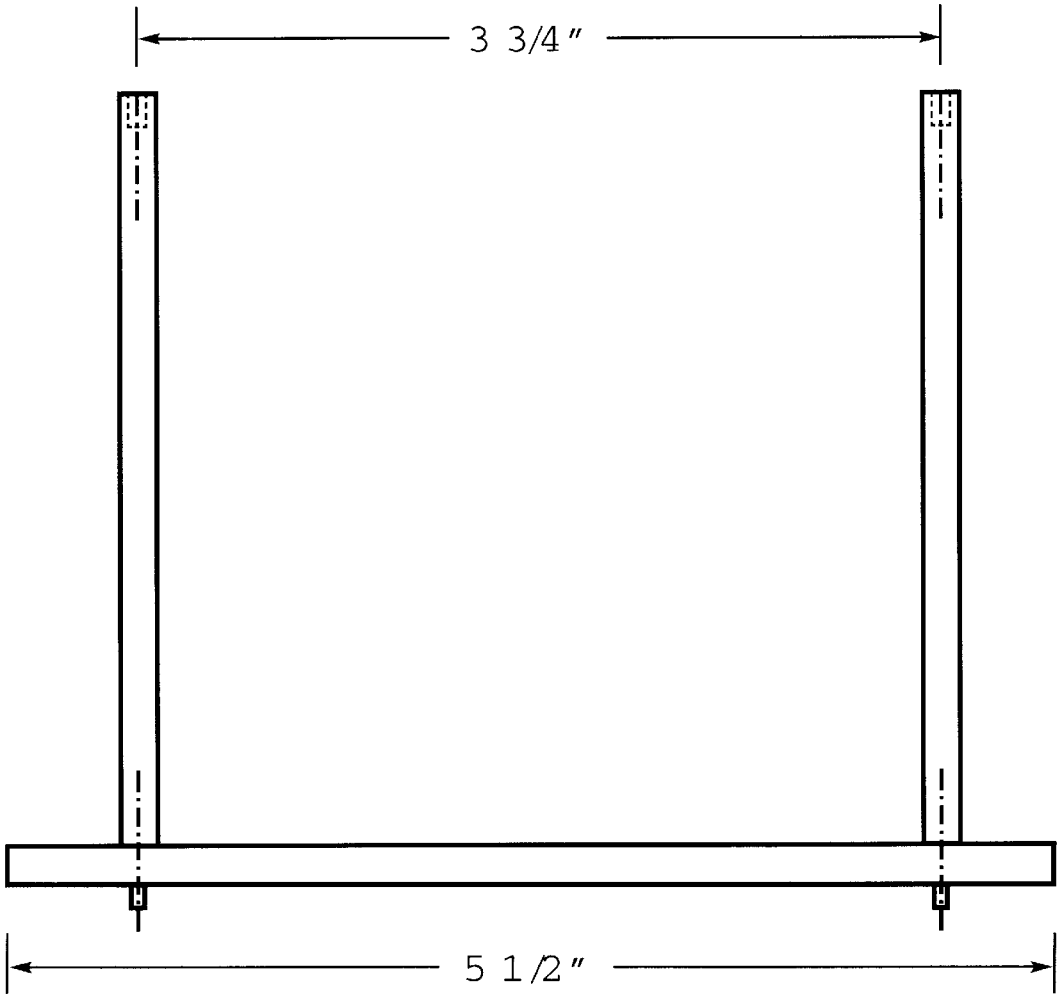
FIG. 2
Figure 3:
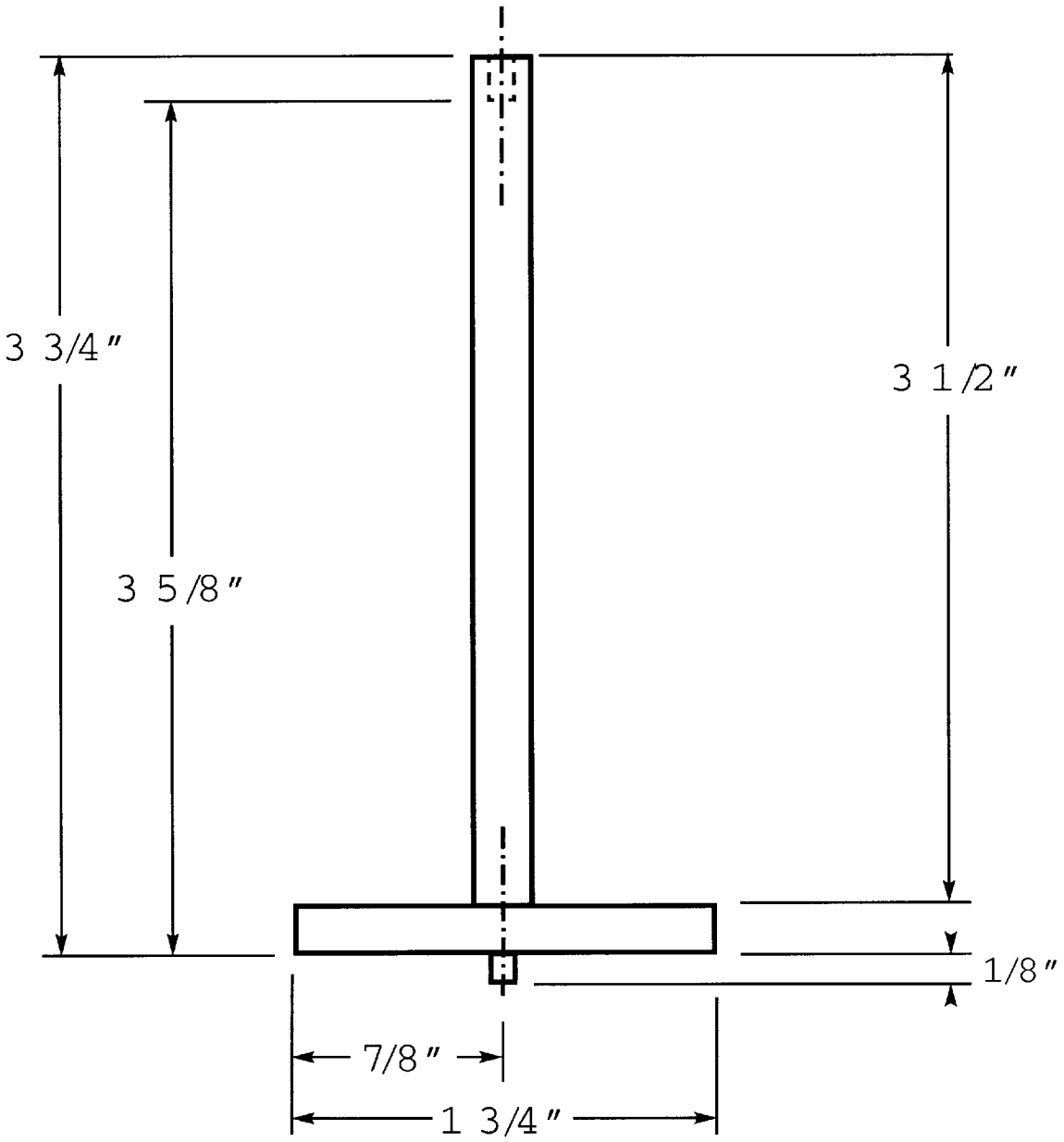
FIG. 3
Figure 4:
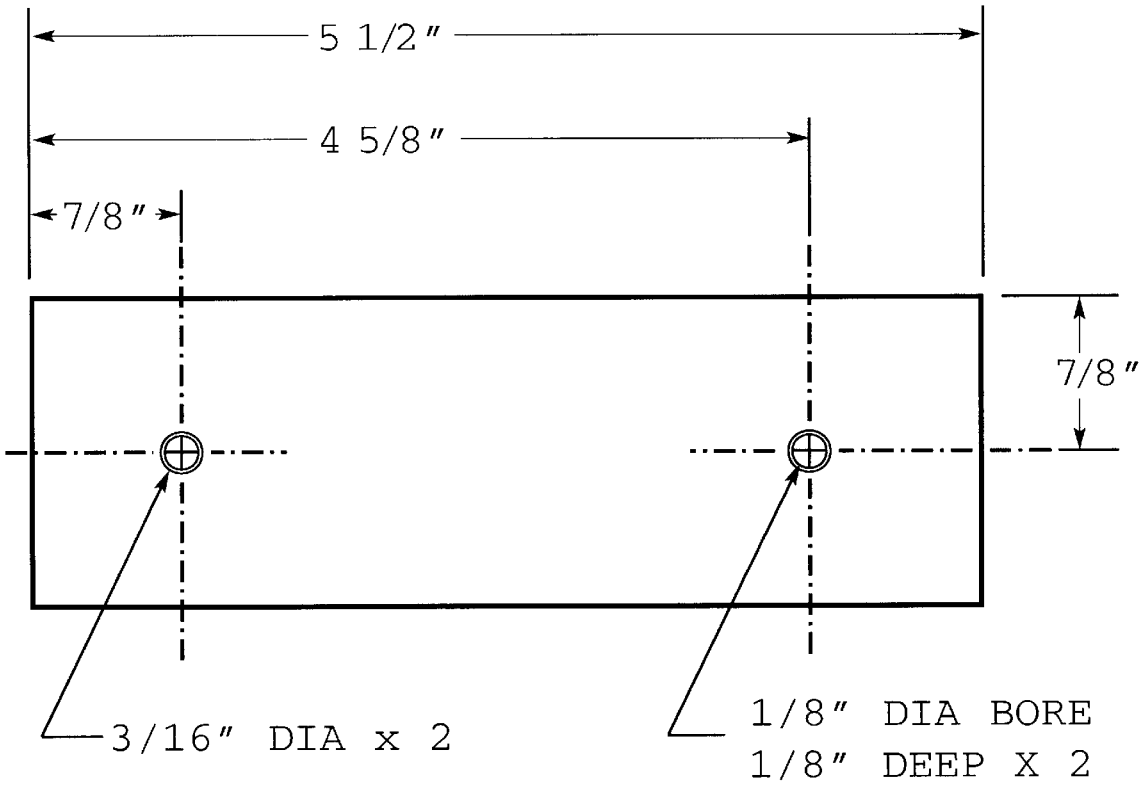
FIG. 4
Figure 5:
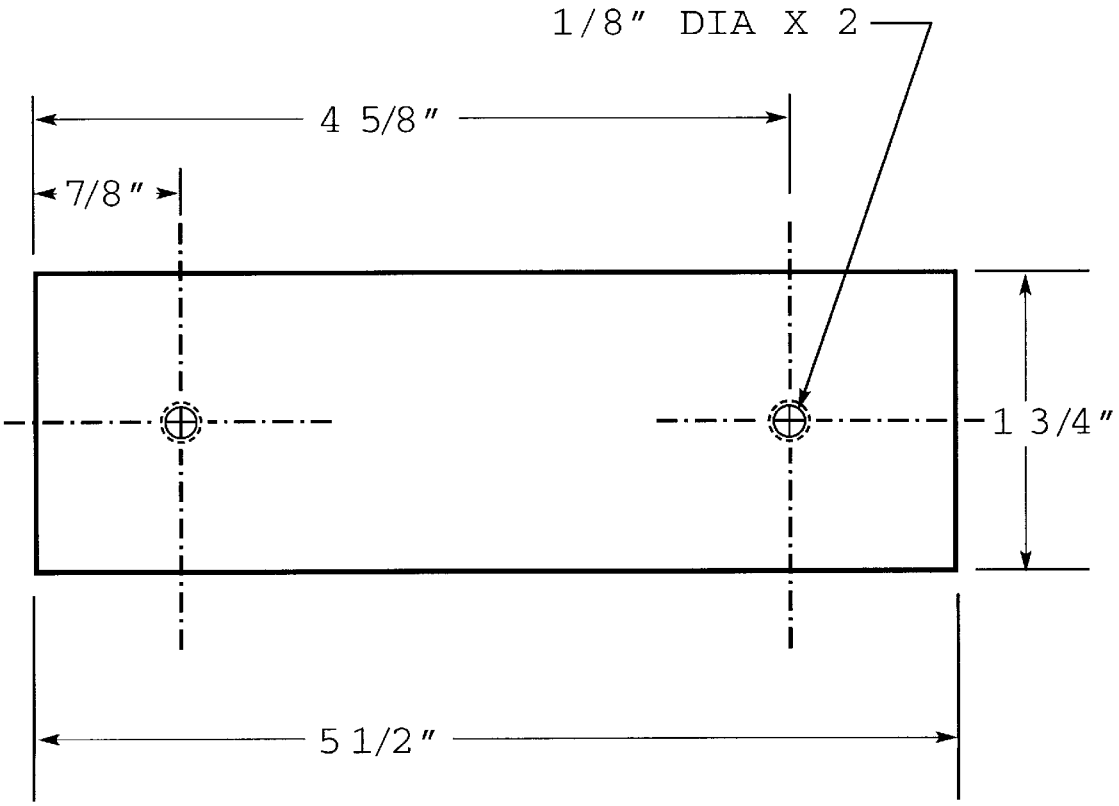
FIG. 5
Figure 6:
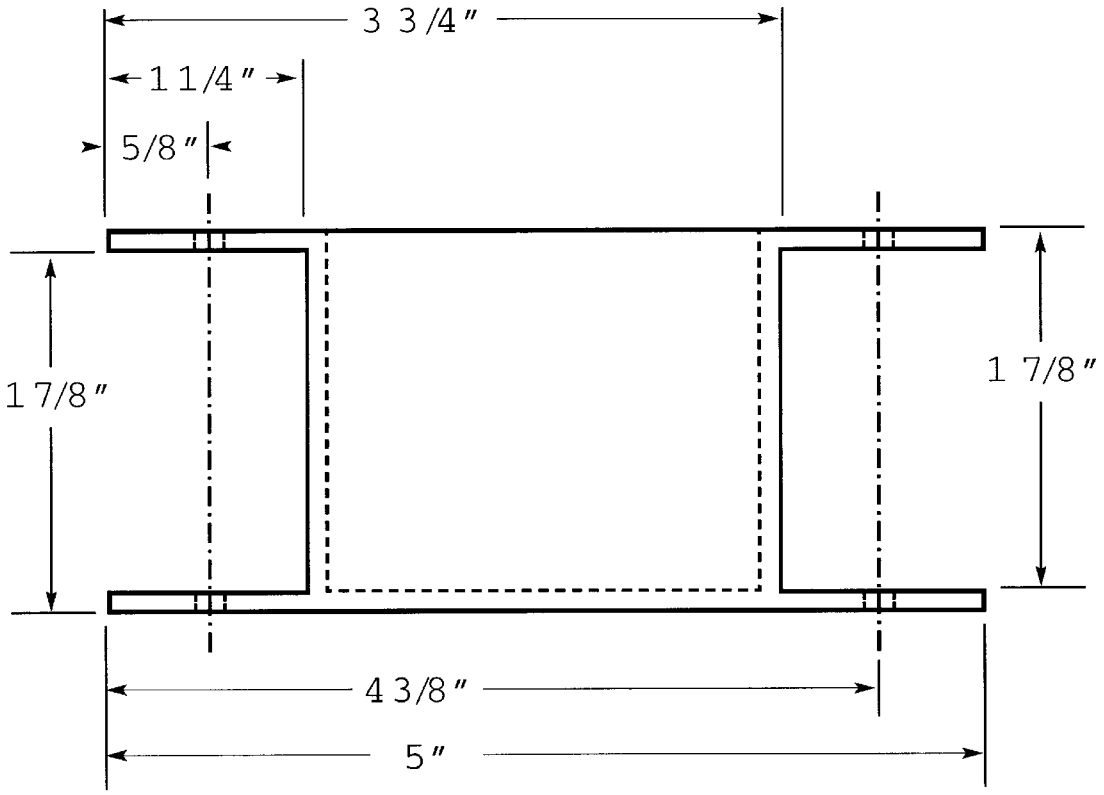
FIG. 6
Figure 7:
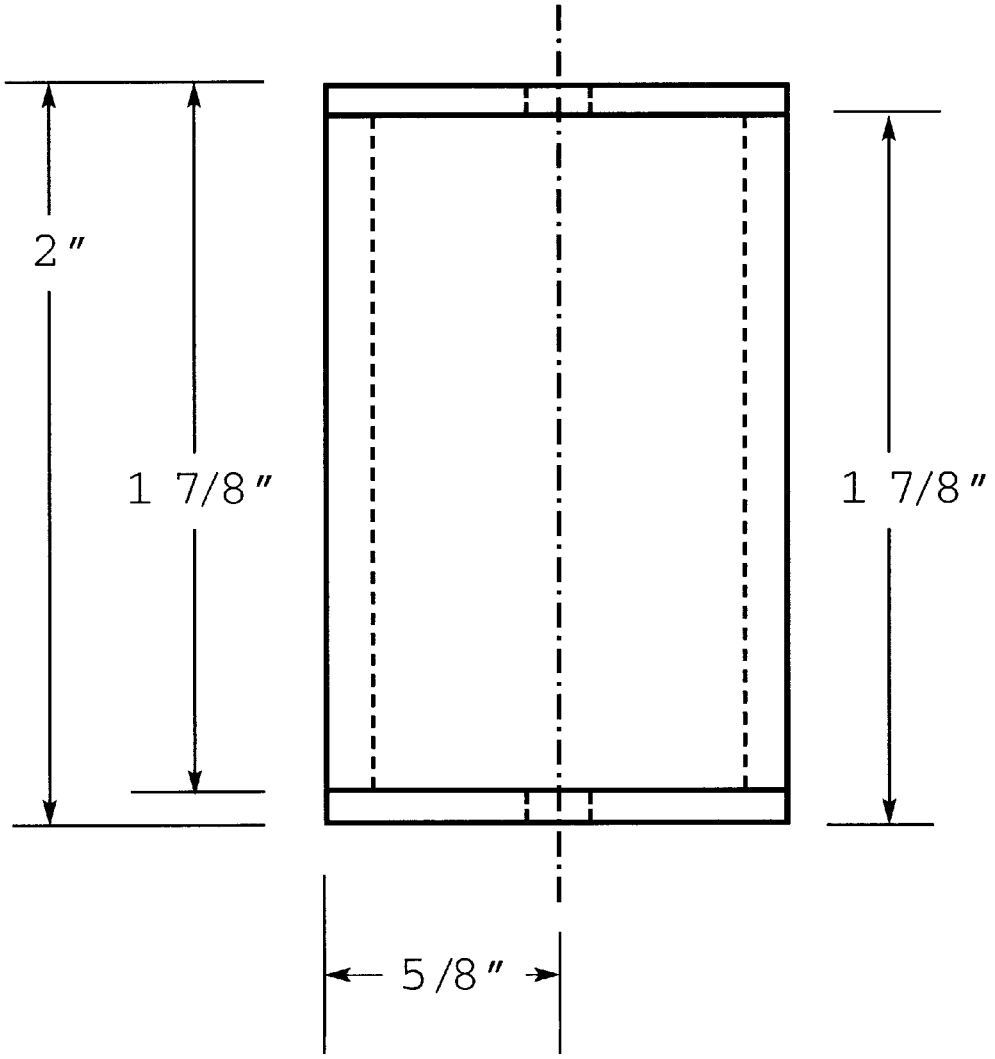
FIG. 7
Figure 8:
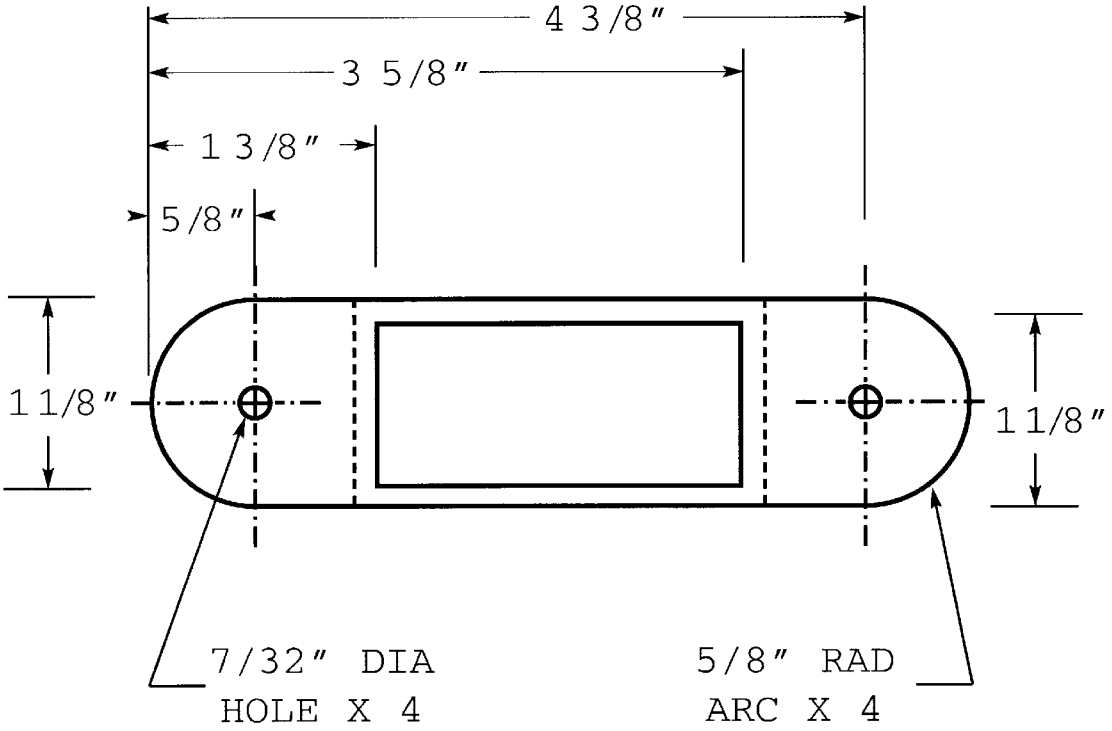
FIG. 8
Figure 9:
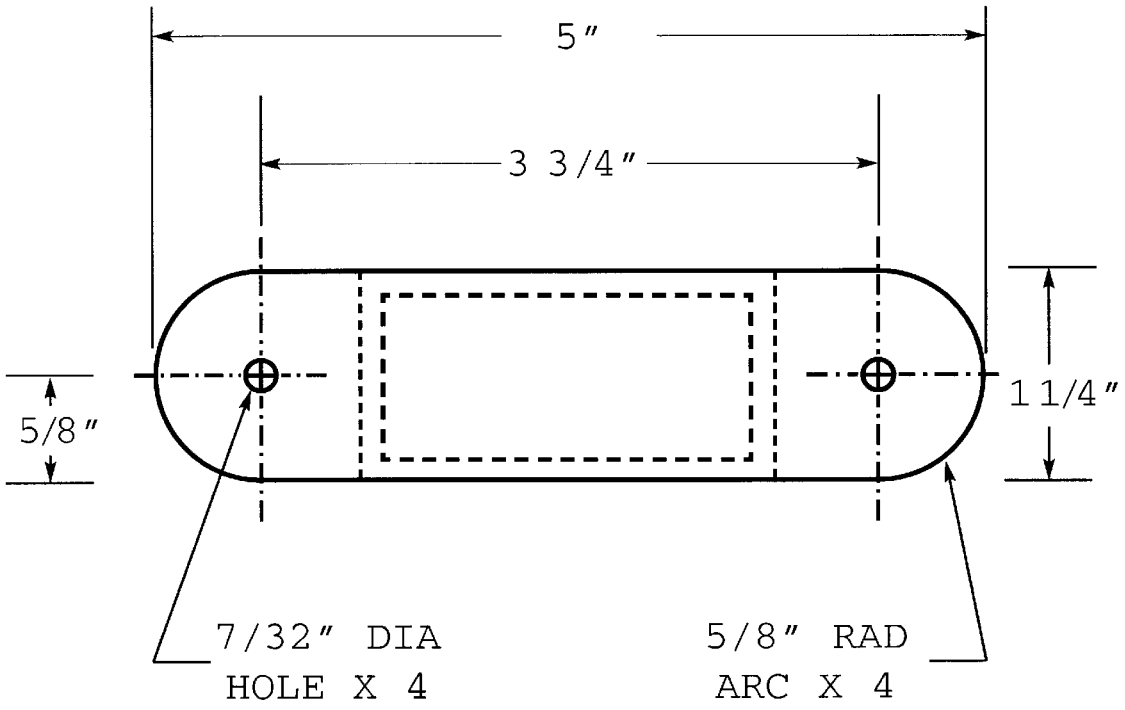
FIG. 9

As shown in the drawings, the present cigarette packing invention is comprised of separate pieces. These pieces are a base, a cigarette housing, two springs, two rubber caps, and two suction cups. These pieces are shown in their proper location and size, from a frontal view point, in FIG. 1.

The base of the invention is one solid plastic piece which is easily reproduced once molded. The base consists of a flat rectangular portion 5½" by 1¾" and ¼" thick with the largest flat surface lying horizontal. The longer 5½" side is noted as being the front side of the invention. Two cylindrical shafts 3/16" in diameter rise 3½" perpendicular from the top of the flat portion of the base. These shafts are positioned 3¾" apart from one another, from center point to center point. The center points of these shafts are also located ⅞" away from the edges of the 5½" side and ⅞" away from the 1¾" side of the flat rectangular portion of the base. A bored hole ⅛" in diameter and ⅛" in depth is located in the very top of each base shaft, on the same center lines as the shafts themselves.

Also on the same center lines, but on the bottom side of the base, are two ⅛" cylindrical stubs ⅛" in length from the bottom of the flat portion of the base. Refer to FIGS. 2–5 for further details on the base dimensions.

The cigarette housing piece of the invention is also one solid plastic piece. The housing is made to fit onto the shafts of the base. The four holes of the housing are slightly bigger than the diameter of the base shafts. The holes of the housing are 7/32" in diameter. This allows the housing to slide easily, up and down on the base shafts. A rectangular opening is located in the top of the housing large enough to house a standard pack of cigarettes. A pack of cigarettes are meant to be placed upside down or filters first into this opening in the top of the housing. The height of the housing is 2". Refer to FIGS. 6–9 for further details on the housing dimensions.

With the 2" high housing on the 3½" base shafts, this leaves room for the 1½" long springs to fit above the housing on the shafts. The springs have a diameter of ¼", slightly larger than that of the base shafts and the holes of the housing. These springs are meant to create tension as the cigarette housing is pulled upward by one's hand. Refer to FIGS. 12A and 12B for spring size and diameter.

The housing and the springs of the invention are held in place and kept from sliding off the base shafts by two rubber caps. One rubber cap fits in the top of each base shaft. The caps, made of tough rubber, consists of a 5/16" diameter top which is 1/16" thick and a stem ⅛" in diameter and ⅛" in length. The stems of the rubber caps fit into the Bored holes in the top of the base shafts. The rubber cap stems are the same diameter as the bored holes in the base, so once the stems are pushed into the bored holes the pressure of the rubber against the plastic bored holes holds the rubber caps in place. A small amount of quick drying epoxy applied to the stems of the rubber caps is used to strengthen the bond between the rubber caps and the base shafts. This creates a strength greater than that of the pressure from the springs as the housing is pulled upward by one's hand. Refer to FIGS. 10A, 10B and 10C for proper dimensions of the rubber caps.

1" diameter suction cups, made of rubber, attached to the suction cup attachments located on the bottom of the base secure the entire invention to any smooth surface. Like with the rubber caps, quick drying epoxy is used to strengthen the bond between the suction cups and the base. The hold to a smooth surface created by the suction cups is greater than any tension from the springs, therefore the base of the cigarette packing device is held stationary while the housing is repeatedly pulled upward and released by one's hand to create consistently packed cigarettes. Refer to FIGS. 11A and 11B for additional information concerning the suction cups.

I claim:

1. A cigarette packing device for use in the compression of tobacco located within cigarettes toward the filters of said cigarettes, said packing device comprising an anchored base with base shafts perpendicularly attached to said base, said base shafts having a first end and a second end having end caps attached thereto, a housing formed to accommodate a standard manufactured pack of cigarettes, slidably and freely moves, but is contained along said base shafts, between said housing and said end caps, along the base shafts, are springs for applying a force on said housing such that said housing is pushed toward said base.

* * * * *